United States Patent [19]

Abell et al.

[11] 4,057,979

[45] Nov. 15, 1977

[54] REFRIGERANT COMPRESSOR UNIT

[75] Inventors: Richard S. Abell, Manlius; Tadek M. Kropiwnicki, W. Syracuse, both of N.Y.

[73] Assignee: Carrier Corporation, Syracuse, N.Y.

[21] Appl. No.: 738,766

[22] Filed: Nov. 4, 1976

[51] Int. Cl.[2] ..... F25B 43/02; F25B 39/04

[52] U.S. Cl. ..... 62/469; 62/508; 417/902

[58] Field of Search ..... 62/468, 470, 508, 469; 417/902

[56] References Cited

U.S. PATENT DOCUMENTS

| | | | |
|---|---|---|---|
| 2,738,657 | 3/1956 | Jacobs | 62/508 |
| 2,904,971 | 9/1959 | Kosfeld | 62/469 |
| 3,008,628 | 11/1961 | Gerteis et al. | 62/469 |
| 3,866,438 | 2/1975 | Endress | 62/468 |

*Primary Examiner*—Lloyd L. King

*Attorney, Agent, or Firm*—J. Raymond Curtin; Barry E. Deutsch

[57] ABSTRACT

A hermetically sealed compressor has a supply of lubricant contained in its sump defined by the inner surface of the hermetically sealed shell. The level of the lubricant supply is above the bottom wall of the compressor cylinder block. The cylinder block includes a drain opening in the bottom wall thereof. A valve is biased to close the drain opening to prevent oil from flowing from the sump into the cylinder block as a result of the pressure in the block being lower than the pressure within the shell acting on the surface of the oil in the sump when the pressure in the cylinder block is greater than the pressure within the shell. The valve permits the drainage of lubricant from the cylinder block to the sump.

2 Claims, 2 Drawing Figures

REFRIGERANT COMPRESSOR UNIT

BACKGROUND OF THE INVENTION

This invention relates to a hermetically sealed refrigeration compressor, and in particular, to one having a pressurized cylinder block.

In a conventional type of sealed compressor unit used in refrigerating systems, the unit is mounted with the crankshaft extending vertically. The lower portion of the cylinder block is immersed in a supply of oil, or other lubricant, contained in a sump defined by the bottom wall of the outer sealed casing or shell. Adequate lubrication is supplied to the moving parts of the compressor by an oil pump, the oil returning to the oil sump through a drain opening in the bottom wall of the cylinder block. The cylinder block is closed, except for the drain opening and is therefore pressurized because of piston "blow-by gas," that is gas at discharge pressure which has by-passed the sealing means between the compressor pistons and cylinders to pressurize the cylinder block. An example of a compressor of this type is illustrated in U.S. Pat. No. 3,008,628. Generally, the lubricating oil freely drains through the opening to the sump since the sump is at suction pressure. That is to say, the pressure within the hermetically sealed shell is suction pressure and it is this pressure which acts on the surface of the oil stored in the sump.

Compressors of the type described may be employed in heat pump applications. Typically, in the heating mode of operation, it is necessary to defrost the outdoor coil then functioning as a refrigerant evaporator. Hot gas at discharge pressure is typically employed to defrost the outdoor coil. The hot gas returns to the suction side of the compressor thereby substantially increasing the pressure acting on the surface of the oil stored in the sump. In fact, the pressure acting on the surface of the oil may exceed the pressure in the cylinder block resulting from the blow-by gas. This can result in a reverse flow of oil through the drain opening in the bottom of the cylinder block. That is, the oil may now flow from the sump into the cylinder block, creating an excess quantity of oil in the block.

This excess quantity of oil in the cylinder block can increase power consumption and prevent proper seating of the piston rings, with the result that the oil will be pumped past the rings into the refrigerant discharge line, which per se is not desirable and whereby the volume of the oil stored in the sump may be reduced so that there is an insufficient amount of oil pumped to the moving parts of the compressor.

SUMMARY OF THE INVENTION

It is therefore an object of this invention to improve the performance of a hermetically sealed compressor of the type having a pressurized cylinder block, particularly when the compressor is used in a heat pump system.

It is a further object of this invention to prevent the flow of oil from the oil sump into the cylinder block of a compressor unit.

It is yet another object of this invention to prevent the reverse flow of oil from the oil sump into the cylinder block when the lubricating oil in the sump is subjected to a pressure in excess of the pressure in the cylinder block.

These and other objects of the present invention are attained in a hermetically sealed compressor having oil drain means to permit the free flow of oil from the cylinder block to the oil sump. Check valve means automatically permits this normal oil flow, yet prevents the oil from undergoing a reversal of flow direction through the drain from the oil sump to the cylinder block.

DESCRIPTION OF THE PREFERRED EMBODIMENT

Figure 1:
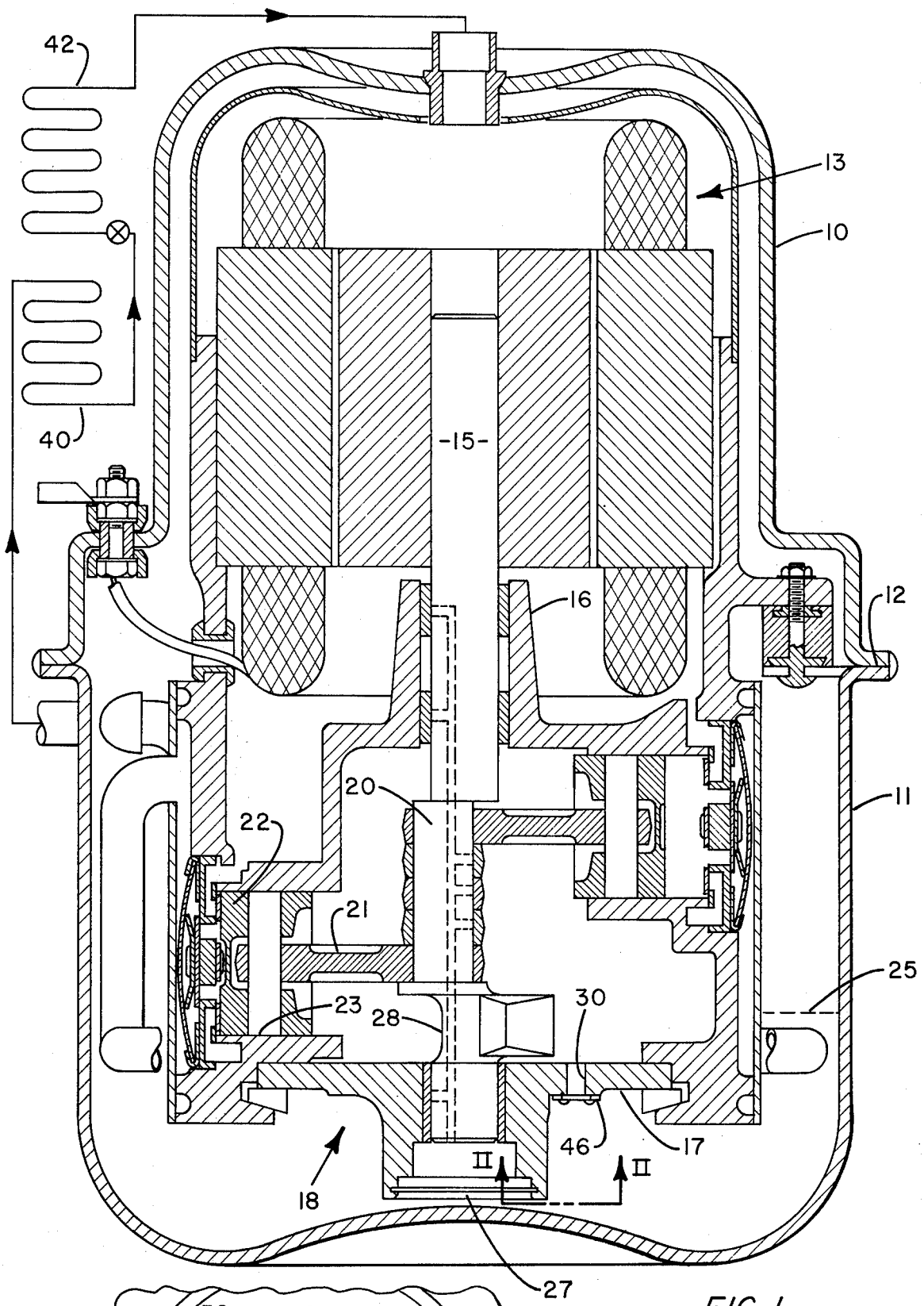
FIG. 1 is a vertical sectional view of a compressor including the present invention.
Figure 2:
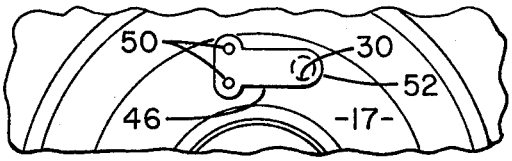
FIG. 2 is a fragmentary plan view of the bottom wall of the compressor cylinder block, as indicated by line II—II of FIG. 1.

The compressor unit consists of an outer casing having an upper section 10, and a lower section 11, which are hermetically sealed together at the joint 12, as by welding. Compressors of this type are typically employed in refrigeration units or heat pump units employed in air conditioning systems in residential or commercial applications. A motor 13 is mounted in the upper casing section 10; the rotor of the motor is affixed to the upper end of a vertically disposed crankshaft 15 journaled in the top wall 16 and bottom wall 17 of compressor cylinder block 18 disposed in lower casing section 11.

Crankshaft 15 is formed with crank throw 20 to receive connecting rods 21 connected at their outer ends to pistons 22 mounted for reciprocation in radially disposed cylinders 23.

The inner surface of lower casing section 11 serves as a reservoir or sump containing a supply of oil, or other lubricant, having a normal level indicated at 25. An oil pump 27 is operatively connected to the lower end of the crankshaft, and functions to pump oil from the supply upwardly through passage 28 formed in the crankshaft, for distribution to the connecting rod bearings and the crankshaft upper main bearing mounted in top wall 16 of the cylinder block. The free surface of the oil in the sump has suction pressure acting thereon.

The cylinder block is closed, except for a drain opening 30 in the bottom wall 17 thereof, for the return of oil from the block to the reservoir.

During normal operation of the compressor in the cooling mode of an air conditioning system, some gas at discharge pressure (blow-by gas) enters into the cylinder block to pressurize same. The blow-by gas is developed as a result of imperfections in the sealing means utilized between the pistons and cylinders. The pressure in the cylinder block will attain a value between suction and discharge pressures. The greater pressure in the cylinder block in combination with gravitational force, will drive the lubricating oil from the cylinder block, through drain opening 30, back to the lubricating oil sump.

As noted previously, compressors of the type described may be employed in both refrigeration and heat pump units. In heat pump applications, the outdoor coil of a mechanical air conditioning system, illustrated in FIG. 1 by coil 40, functions as a refrigerant evaporator. As is recognized by those skilled in the art, the indoor coil 42 functions as a refrigerant condenser. Heat may thus be extracted from ambient air and transferred to occupied areas for increasing the temperature therein.

When operating at low ambients, outdoor coil 40 will frequently develop frost on the surface thereof. To maintain efficient and effective operation, this frost must be removed. Typically, hot gas at substantially discharge pressure is supplied to outdoor coil 40 for defrost purposes. The hot gas is then returned to the suction side of the compressor. It has been found, during such operation, the pressure acting on the surface of the oil stored in the lubricating oil sump, may exceed the pressure developed in the cylinder block by the blow-by gas. This pressure differential will cause a reverse flow of oil through drain opening 30; that is to say, the lubricating oil will be forced from the sump into the cylinder block, creating an excess of oil in the block. Such excess oil may be driven from the cylinder block through the refrigerant lines of the system, thereby possibly causing lubricating oil starvation at the bearings of the compressor. In addition, the efficiency of the compressor will degrade due to increased power consumption necessitated to overcome the forces generated by the excess oil in the cylinder block.

This condition may be avoided by providing a check valve 46 for the opening 30 in the bottom wall 17 of the cylinder block. This valve may comprise a flap valve fixed to the exterior surface of the bottom wall 17, as by fasteners 50, with the opposite end 52 of the flap valve overlying opening 30. The flap valve is formed of resilient or spring sheet material, and is tensioned to normally close opening 30. However, when the pressure in the cylinder block exceeds the pressure acting on the surface of the oil stored in the sump, valve 46 will move outwardly from the bottom wall, permitting the oil discharged from the bearings to drain into the oil reservoir. However, upon a reversal in the pressure differential between the cylinder block and free surface of the lubricating oil, valve 46 will close, preventing any transfer of oil from the sump into the cylinder block through opening 30 and accordingly, prevents excess accumulation of oil in the cylinder block.

While a preferred embodiment of the present invention has been described and illustrated, the invention should not be limited thereto, but may be otherwise embodied within the scope of the following claims.

We claim:

1. In a refrigerant compressor unit comprising a sealed casing, a reciprocating piston type compressor mounted in said casing, said compressor having a closed cylinder block including a bottom wall positioned in proximity to the bottom wall of said casing, a crankshaft journaled vertically in said cylinder block, said casing serving as an oil sump surrounding said cylinder block and containing an oil supply at a level above the bottom wall of said cylinder block, an oil pump operable to pump oil from said supply to the working parts of the compressor in said cylinder block, said bottom wall of said cylinder block being formed with a drain opening therethrough to permit lubricating oil to return from said cylinder block to said oil sump, the pressure in said cylinder block exceeding the pressure acting on the surface of said oil in said sump in a first operating condition of said compressor, with said pressure acting on the surface of said oil exceeding the pressure in said cylinder block in a second operating condition of said compressor, the improvement comprising:

a valve normally closing said drain opening, said valve opening when the pressure in the cylinder block exceeds the pressure acting on the surface of said oil to permit the return of oil from said cylinder block to said oil sump via said drain opening, said valve assuming its normally closed position relative to said drain opening when the pressure acting on the surface of said oil exceeds the pressure in said cylinder block to prevent oil from flowing from said sump through said drain opening to said cylinder block.

2. In the compressor unit as defined in claim 1, wherein said valve is of the spring actuated flap type mounted on the exterior of said bottom wall of said cylinder block.

* * * * *